United States Patent [19]

Thuries et al.

[11] 4,439,651

[45] Mar. 27, 1984

[54] PRESSURIZED GAS CIRCUIT-BREAKER HAVING OPENING AND CLOSING RESISTORS

[75] Inventors: Edmond Thuries; Dante Nicoloso; Doan Pham Van, all of Meyzieu, France

[73] Assignee: Alsthom-Atlantique, Paris, France

[21] Appl. No.: 407,410

[22] Filed: Aug. 12, 1982

[30] Foreign Application Priority Data

Aug. 26, 1981 [FR] France ..... 81 16291

[51] Int. Cl.[3] ..... H01H 33/16

[52] U.S. Cl. ..... 200/144 AP; 200/148 A

[58] Field of Search ..... 200/144 AP, 148 A

[56] References Cited

U.S. PATENT DOCUMENTS 4,009,458 2/1977 Kishi et al. ..... 200/148 A 4,338,500 7/1982 Pham Van et al. ..... 200/144 AP

*Primary Examiner*—E. A. Goldberg

*Assistant Examiner*—Morris Ginsburg

*Attorney, Agent, or Firm*—Sughrue, Mion, Zinn, Macpeak & Seas

[57] ABSTRACT

Pressurized gas circuit-breaker for very high voltages having opening and closing resistors, comprising, in a main insulative enclosure (1), a fixed contact (21, 101), a movable contact (32, 34, 62), a closing resistor (8) and a device (19) for inserting the closing resistor, the circuit-breaker further comprising, in an auxiliary insulative enclosure (120), a movable auxiliary contact (121), a fixed auxiliary contact (131) and an opening resistor (133), the circuit-breaker being characterized in that the movable auxiliary contact (121) is moved by a mechanism disposed in a casing (150) common to both enclosures (1, 120) and on the side of the fixed contact (21, 101), the mechanism comprising a link-crank assembly (152, 152') and a bell-crank lever having two arms (154A, 154B). Application to circuit-breakers for very high voltages.

2 Claims, 5 Drawing Figures

PRESSURIZED GAS CIRCUIT-BREAKER HAVING OPENING AND CLOSING RESISTORS

FIELD OF THE INVENTION

The present invention relates to an insulative gas circuit-breaker having opening and closing resistors.

BACKGROUND OF THE INVENTION

The invention is more particulary applicable to a circuit-breaker insulated with sulphur hexafluoride ($SF_6$) at a pressure of a few bars.

A gas (e.g. $SF_6$) insulated circuit-breaker generally interrupts a capacitive current without causing any voltage surge; on the other hand, voltage surges in a ratio exceeding 2:1 may occur when the circuit-breaker interrupts an inductive current such as the load current of a shunt reactance or the current through a high-power transformer with a reactive load.

In the case of very high voltage networks, at voltages above 245 kV, for example, the line circuit-breakers are sometimes fitted with closing resistors which, through closing the circuit in two stages, reduce the amplitude of voltage surges which may occur on the network when closing on an open-circuit line.

The value of this closing resistor is similar to the surge impedance on the line, that is to say 300 to 600 ohms.

To reduce the voltage surges due to the interruption of an inductive current before it passes through zero amplitude it is beneficial to use an opening resistor of higher value, around 2000 ohms.

The use of the closing resistor as the opening resistor has been envisaged; at first sight this solution would appear more economical than providing the circuit-breaker with both a closing resistor and an opening resistor.

However, while a closing resistor may be housed in the opening chamber of a circuit-breaker (on this topic refer to French Patent Application No. 80 16222 dated July 23, 1980 and the first Patent of Addition thereto No. 89 06444 dated Mar. 31, 1981), an opening resistor requires an interrupting device the size of which is inversely proportional to the opening resistor value. It has therefore been preferred to add to a circuit-breaker having a main chamber containing a closing resistor an auxiliary chamber containing an opening resistor.

On this topic reference should be had to 1964 CIGRE (Conférence Internationale des Grands Réseaux Electriques) Communication No. 138: "Problèmes apparaîssant aux tensions les plus élevées lors de la manoeuvre de disjoncteurs" ("Problems arising on operation of circuit-breakers at very high voltages") by E MAURY.

The circuit-breaker described in this communication is equipped with various mechanisms for opening and closing the various main and auxiliary chamber contacts in a predetermined sequence.

This results in a complicated mechanism, but the presence of a source of pressurised gas facilitates the actuation of the various components.

In the case of a circuit-breaker insulated with $SF_6$ where there is no compressed air supply a simpler mechanism is required, providing for inserting or removing the various opening and closing resistors in a single operation.

One objective of the present invention is to provide a gas-insulated circuit-breaker having at least one closing resistor and at least one opening resistor and mechanisms for inserting and disconnecting said resistors in accordance with sequences required by the operation of the circuit-breaker wherein the insertion mechanisms are simple and require no power source other than that displacing the movable main contacts.

SUMMARY OF THE INVENTION

The present invention consists in a pressurised gas circuit-breaker having opening and closing resistors and comprising, in a main insulative enclosure, a fixed contact, a movable contact, a closing resistor and a device for inserting the closing resistor in the form of a semi-movable contact co-operating with the movable contact. The circuit-breaker further comprises, in an auxiliary insulative enclosure, a movable auxiliary contact, a fixed auxiliary contact and an opening resistor. The circuit-breaker is characterised in that the movable auxiliary contact is moved by a mechanism disposed in a casing common to both enclosures and on the side of the fixed contact opposite the main contact actuating mechanism casing. The mechanism comprises a link-crank assembly and a bell-crank lever having two arms, said assembly and said bell-crank lever being pivoted to respective ends of at least one pushrod with one of the pivots being made via a slot in the pushrod, the crank of the assembly being pivoted to the movable auxiliary contact, one arm of the bell-crank lever being acted on by a return spring and the other arm being fitted with a roller in contact with an extension of the semi-movable contact for inserting the closing resistor.

The invention will be better understood from the following description of an embodiment of the invention given by way of non-limiting example only and with reference to the accompanying drawings.

DESCRIPTION OF THE PREFERRED EMBODIMENT

Figure 1:
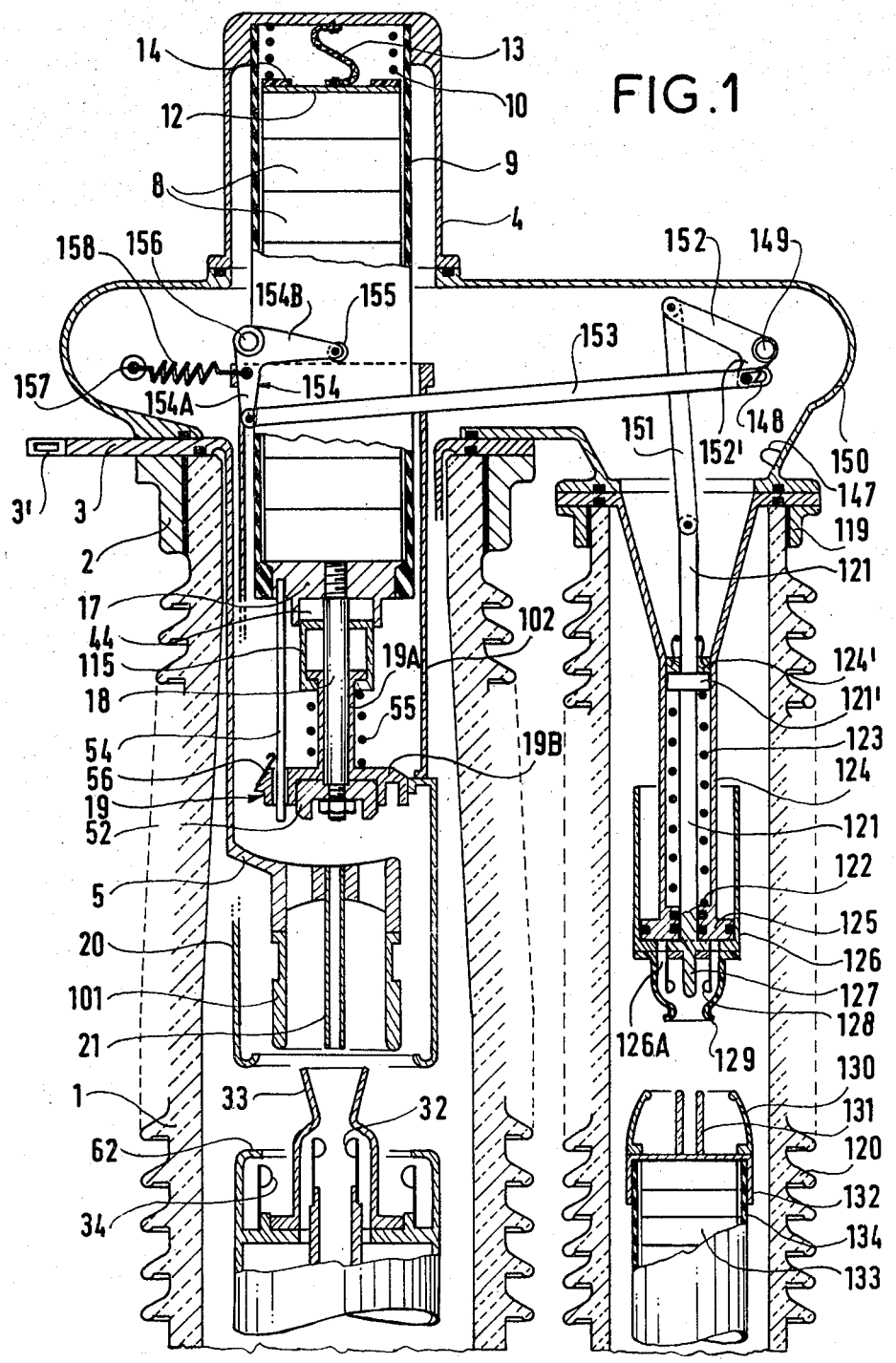
FIG. 1 is a partial schematic cross-section through a circuit-breaker in accordance with the invention in the open position.

FIG. 1 shows part of the circuit-breaker in accordance with the invention in axial cross-section.

It comprises an insulative housing 1 closed at its lower end by a casing (not shown) which contains mechanisms for displacing the movable contacts when the circuit-breaker is opened or closed.

The upper end of enclosure 1 comprises a collar 2 and a plate 3 carrying an external connection terminal 3'.

To the lower end of plate 3 is attached a fixed contact support 5. Fixed in sealed manner to the upper part is a tubular casing 4 containing a resistor 8, parts 4 and 5 being with advantage assembled together prior to fitting into enclosure 1. The casing is of metal, pure aluminium or aluminium alloy, for example.

Resistor 8 is formed of stacked cylindrical elements and is placed in an insulative cylinder 9 which is not affected by the decomposition products of sulphur hexafluoride. A spring 10 compresses the elements of resistor 8 to ensure good contact between them. A braid 13 shunts the spring and an insulative washer 14 is placed between spring 10 and a metal plate 12 compressing resistor 8. The lower end of cylinder 9 is closed by a plug 17 having a central shoulder which supports a guide rod 18 on which slides a semi-movable insertion device 19 carrying at its lower end a tubular contact 20 for insertion of resistor 8.

Fixed contact support 5 carries main fixed contacts 101 and a fixed arcing contact 21.

The movable assembly comprises a movable arcing contact 32, a blowing nozzle 33, a movable main contact 34 and a movable insertion contact 62 for inserting the closing resistor.

Insertion device 19 is in the form of a cylinder 19A terminating in a bell member 19B. Cylinder 19A slides on rod 18. Its downward travel is limited by a stop 52 screwed to the rod and co-operating with bell member 19B.

Cylinder 19A has one end which can slide in a cylindrical cage 115 which can itself slide in a bore 44 in plug 17.

A spring 55 is disposed between cage 115 and bell member 19B.

The assembly 19-115-55 acts as a damper on closing of the circuit-breaker and delays movement of the insertion device on opening of the circuit-breaker, so that the resistor is inserted only when the circuit-breaker is closed.

Device 19 is guided by a fixed rigid rod 54 co-operating with a rubbing member 56.

The auxiliary chamber contains, in a ceramic enclosure 120, resistors in the form of discs 133 stacked in an insulative cylinder 134 closed by a cap 132 supporting a fixed contact 131; an anti-flashover shroud 130 surrounds the fixed contact. The resistor discs are urged against cap 132 by a spring (not shown) situated at the other end, but similar to that represented by spring 10, plates 12 and 14 and braid 13 for the closing resistor.

The movable part of the auxiliary chamber contact comprises a rod 121 which slides in a sleeve 124 fixed to a flange 119 of enclosure 120; sleeve 124 terminates at the lower end in a piston 125 fitted with seals.

Movable contact rod 121 terminates in an arcing rod 127 co-operating with hollow fixed contact 131 and is formed with fingers 128; an insulative blowing nozzle 129 concentrates the gas blast in the area of the arc on opening; this blast is produced by compressing the gas between movable cylinder 126 and fixed piston 125; orifices 126A are provided for the passage of the gas; a spring 123 bears on the base of piston 122 and on a disc 121' attached to rod 121; a ring 124' carries contact fingers bearing on rod 121 and provides a stop for disc 121'.

Figure 5:
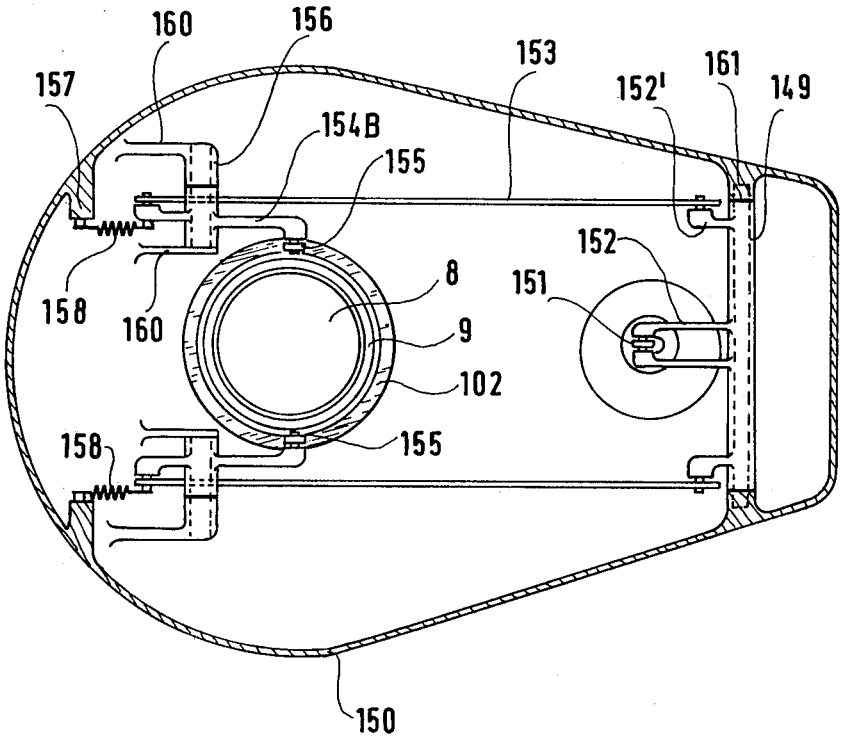
FIG. 5 is a plan view of the operating mechanism of the movable auxiliary contact.

The drive mechanism for the movable contact of the auxiliary chamber is housed in an intermediate casing 150; this mechanism (see also FIG. 5) comprises a link 151 driven by a crank 152 rotating about a shaft 149; crank 152 is part of a lever 152' with two cranks driven by two pushrods 153 situated on each side of resistor block 9. These pushrods operate bell-crank levers 154 rotating about shafts 156. These bell-crank levers have two arms substantially at right angles to one another.

One arm 154A is acted on by a return spring 158; the other arm 154B terminates with a roller 155 and is driven by a cylindrical extension 102 of closing resistor insertion contact 20.

Springs 158 are hooked over bosses 157 and shafts 156 are journalled on fixed bosses 160 provided on casing 150. Similarly, shaft 149 is retained by fixed bosses 161 on casing 150. A stop 147 is shown to the right of casing 150. Pushrods 153 are formed with a slot 148.

The circuit-breaker operates as follows:

FIG. 1 shows the circuit-breaker in the open position; closing of the circuit-breaker consists in the upward displacement of the movable assembly in the main chamber; movable insertion contact 62 comes into contact with tubular contact 20 to insert resistors 8 in circuit as in the abovementioned Patent and Patent of Addition; stop 52 and bell member 19B operating as damper and delay means prevent bounce of the insertion contacts; upward movement of cylindrical extension 102 rotates bell-crank lever 154 about shaft 156, stretching springs 158. Following a dead interval due to slot 148 in pushrod 153, crank 152 turns and pushes rod 121 via link 151, compressing spring 123.

The closing of contacts 127/131 may be obtained prior to shunting of closing resistor 8 by the main contacts of the main chamber; this then places in service resistor 133 which is in parallel with resistor 8, reducing the resistance value inserted, so that closing may proceed in three stages: closing on resistor 8, closing on resistors 8 and 133 in parallel, shunting of resistors 8 and 133; if opening in three stages is not required, the closing of the auxiliary chamber is timed so that the closing resistor is shunted before contacts 127 and 131 come into contact so that the resistance is placed in circuit without an arc being struck as the voltage is the same to each side of contacts 127 and 131.

Figure 2:
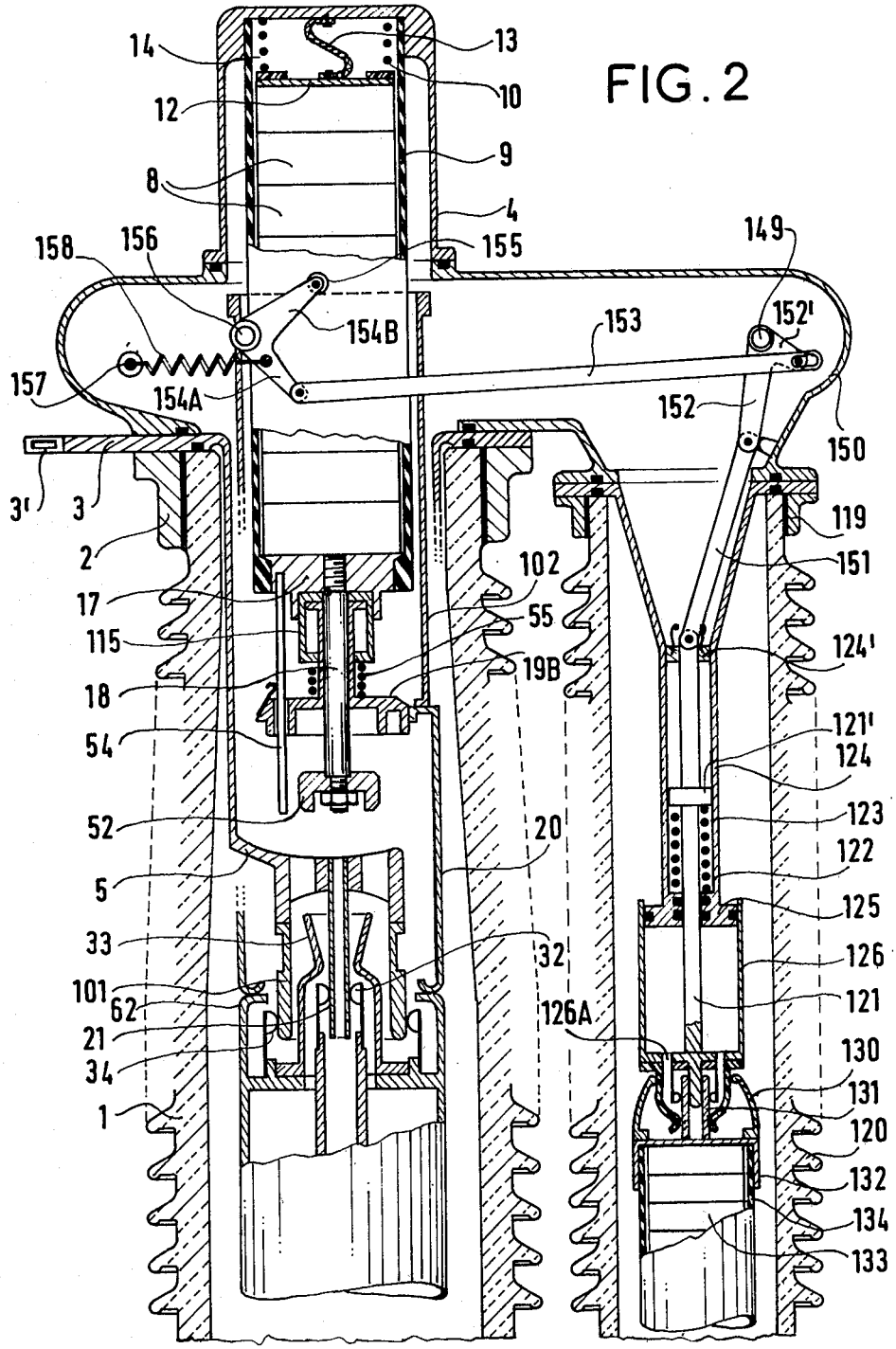
FIG. 2 is a vertical view of the same circuit-breaker in the closed position.

FIG. 2 shows the "apparatus closed" position; at the end of travel crank 152 and link 151 pass through a dead point and spring 123 urges crank 152 against stop 147.

Figure 3:
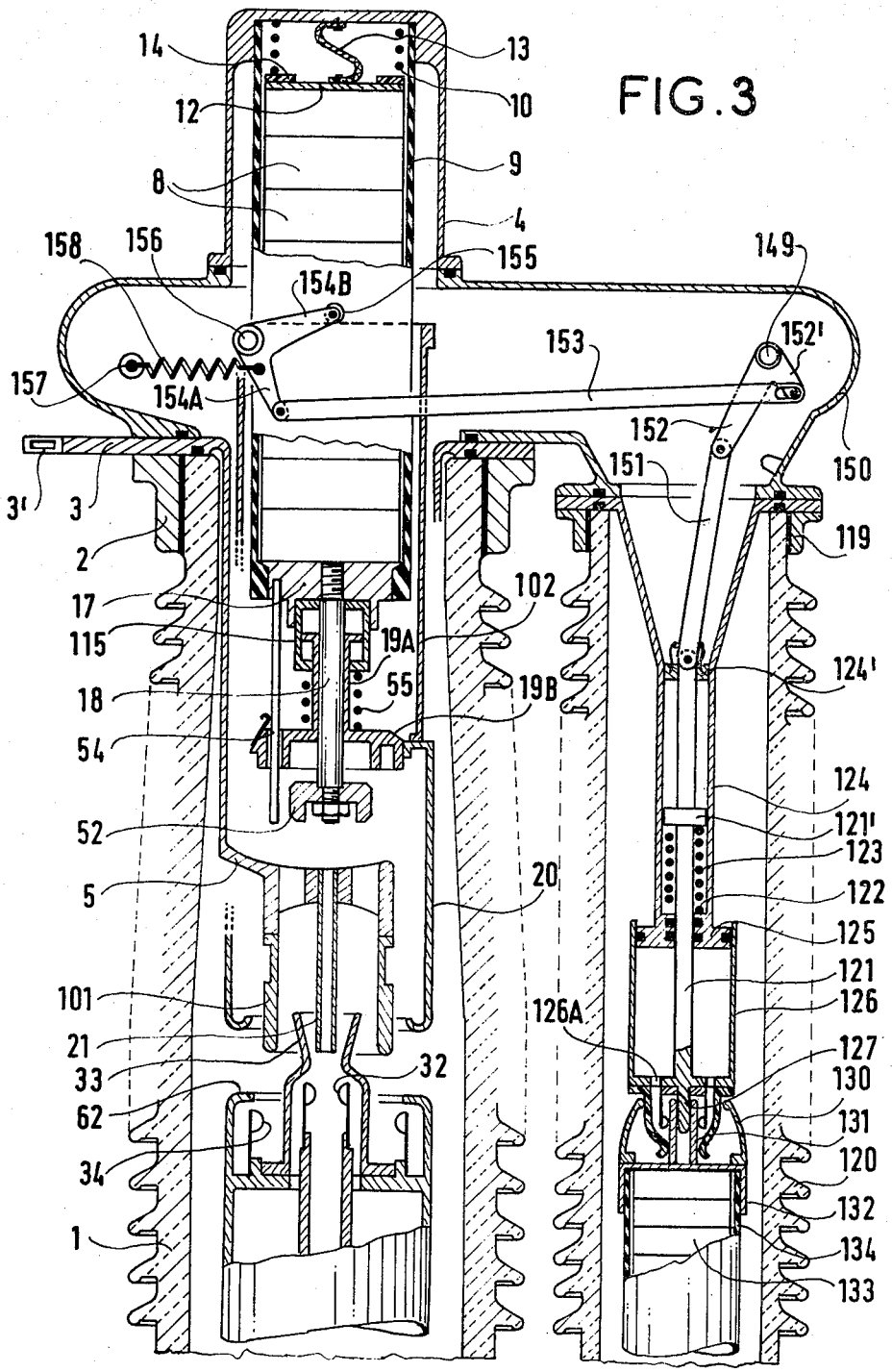
FIG. 3 is a sectional view of the same circuit-breaker at the start of the opening phase.

On opening, FIG. 3, main contacts 34 and 101 and then arcing contacts 21 and 32 separate as a result of which an arc appears between contacts 21 and 32; closing insertion contact 20 is no longer in contact with part 62 as it is held back by the damper/delay combination 17/115, the piston of which is moved by springs 158 which, via bell-crank levers 154, push back cylindrical member 12; there is delayed extraction of cage 115 from bore 44 and displacement of the end of cylinder 19A into cage 115 under the action of spring 55; nozzles are provided to implement the time-delay, or alternatively use may be made of leakage at the guides.

During this time, the auxiliary chamber contacts remain closed provided that the end of slot 148 is not reached. Finally, at the end of slot 148, spring 123 is slightly expanded on passage through the deadpoint of link 151 and crank 152. At this time the movable assembly 121-151-152 is free, slot 148 releasing this movement and, damper 17/115 having finished operating, spring 158 is subject to less resisting force and assists in displacing the auxiliary chamber contact. The current in the main chamber is switched into the auxiliary chamber and passes through resistor 133, so that the current is not cut off until it is resistive and the gas blast produced by the small cylinder 126 and piston 122 is not very powerful; thus there is no voltage surge on interrupting low-amplitude inductive currents.

Operation is identical on interrupting a short-circuit current.

FIG. 3 shows the circuit-breaker in an intermediate phase with the main contacts separated, the arc extinguished in the main chamber and the current flowing through the auxiliary chamber.

Figure 4:
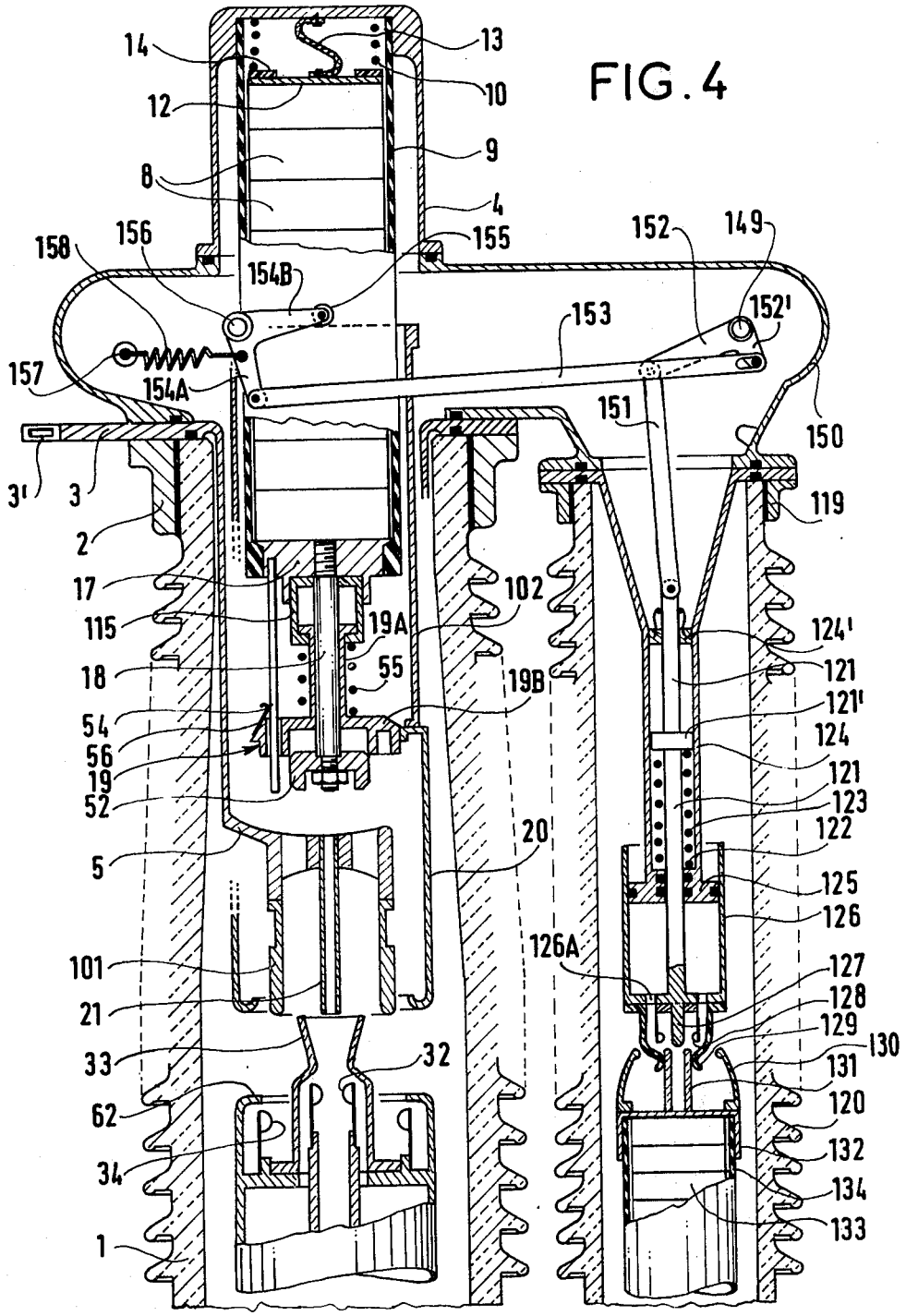
FIG. 4 is a sectional view of the same circuit-breaker towards the end of the opening phase.

FIG. 4 shows the circuit-breaker opening immediately after separation of the auxiliary chamber contacts; the gas is compressed between cylinder 126 and piston 122; the pressure increases as the orifice is closed by nozzle 129 and arcing contact 131; on opening of the orifice the arc is struck and is blown out by the gas blast.

A circuit-breaker in accordance with the invention offers many advantages. By virtue of the facility for inserting resistors in two or three stages on closing and for inserting resistors on opening, it may be used equally well to protect long lines as to protect inductive circuits incorporating reactances and open-circuit transformers.

The operating power is low, particularly on opening, as part of the energy for current interruption and the gas blast is stored up on closing.

The control mechanism is simple and requires no power source other than that displacing the movable contacts.

We claim:

1. A pressurised gas circuit-breaker of the opening and closing resistor type and comprising, in a main insulative enclosure (1), a fixed contact (21, 101), a movable contact (32, 34, 62), a closing resistor (8) and a device (19) for inserting the closing resistor (8) in the form of a semi-movable contact (20) operatively engaging the movable contact (32, 34, 62), said circuit-breaker further comprising, in an auxiliary insulative enclosure (120), a movable auxiliary contact (121), a fixed auxiliary contact (131) and an opening resistor (133), the improvement wherein the circuit-breaker comprises a mechanism disposed in a casing (150) linking both enclosures (1, 120) and on the side of the fixed contact (21, 101), for moving the movable auxiliary contact (121), the mechanism comprising a link-crank assembly (152, 152') and at least one bell-crank lever having two arms (154A, 154B), said assembly and said bell-crank lever being pivoted to respective ends of at least one pushrod (153) with one of the pivots being made via a slot (148) in the pushrod, the crank (152) of the assembly being pivoted to the movable auxiliary contact, a return spring (158) acting on one arm (154A) of the bell-crank lever and the other arm (154B) being fitted with a roller (155) in contact with an extension (102) of the semi-movable contact (20) for inserting the closing resistor (8).

2. A circuit-breaker according to claim 1, characterised in that the movable auxiliary contact (121) is disposed in a fixed sleeve (124) comprising a spring (123) which is compressed by the closing movement of the movable auxiliary contact, the sleeve terminating at a piston (125) carried by a cylinder (126) which is attached to the movable auxiliary contact and the base of which is formed with orifices (126A) for gas to escape into a nozzle (129) surrounding the end of the movable auxiliary contact.

* * * * *